US012285102B2

(12) United States Patent
Briosi

(10) Patent No.: US 12,285,102 B2
(45) Date of Patent: Apr. 29, 2025

(54) LOAD-BEARING STRUCTURE FOR SETS OF SHELVES

(71) Applicant: METALSISTEM S.P.A., Rovereto (IT)

(72) Inventor: Antonello Briosi, Rovereto (IT)

(73) Assignee: METALSISTEM S.P.A., Rovereto (IT)

( * ) Notice: Subject to any disclaimer, the term of this patent is extended or adjusted under 35 U.S.C. 154(b) by 0 days.

(21) Appl. No.: 18/251,898

(22) PCT Filed: Nov. 16, 2021

(86) PCT No.: PCT/IB2021/060584
§ 371 (c)(1),
(2) Date: May 5, 2023

(87) PCT Pub. No.: WO2022/106987
PCT Pub. Date: May 27, 2022

(65) Prior Publication Data

US 2024/0008641 A1 Jan. 11, 2024

(30) Foreign Application Priority Data

Nov. 18, 2020 (IT) ..... 102020000027699

(51) Int. Cl.
*A47B 57/48* (2006.01)
*A47B 57/40* (2006.01)
*A47B 57/50* (2006.01)

(52) U.S. Cl.
CPC ..... *A47B 57/482* (2013.01); *A47B 57/402* (2013.01); *A47B 57/408* (2013.01); *A47B 57/50* (2013.01)

(58) Field of Classification Search
CPC ..... A47B 57/482; A47B 57/50; A47B 57/408; A47B 57/402
See application file for complete search history.

(56) References Cited

U.S. PATENT DOCUMENTS 2,925,920 A * 2/1960 Skubic ..... A47B 57/402 108/107
3,697,034 A * 10/1972 Shell ..... A47B 57/42 248/222.13

(Continued)

FOREIGN PATENT DOCUMENTS

CA 2344727 A1 * 10/2002 ..... A47B 57/402
DE 29617219 U1 * 11/1996 ..... A47B 47/024

(Continued)

*Primary Examiner* — Stanton L Krycinski
(74) *Attorney, Agent, or Firm* — ASLAN LAW, P.C.

(57) ABSTRACT

Load-bearing structure comprising one vertical upright, provided with one longitudinal wall and one fastening opening made along the longitudinal wall; one fastening body, provided with one fastening wall and with one fastening portion made cantilevered on the fastening wall, insertable inside the fastening opening and movable in a sliding manner inside the latter between a fastening configuration, in which it is coupled to the fastening opening, by fastening the vertical upright to the fastening body, and one free configuration, in which it is uncoupled from the fastening opening, freeing the vertical upright from the fastening body. The fastening portion comprises a first fastening element, which extends along a first direction of extension (FDE), and a second fastening element, which extends along a second direction of extension substantially transverse to the FDE, the first and the second fastening element being adapted to fasten to the longitudinal wall in the fastening configuration.

10 Claims, 3 Drawing Sheets

(56) References Cited

U.S. PATENT DOCUMENTS 4,023,683 A * 5/1977 Vargo ..... A47B 96/1475 211/192
4,064,996 A * 12/1977 Shillum ..... A47B 57/402 108/107
4,067,445 A * 1/1978 Derclaye ..... A47B 57/402 248/243
4,154,419 A * 5/1979 Breidenbach ..... A47B 57/402 211/187
4,189,250 A * 2/1980 Abbott ..... F16B 7/22 248/222.13
4,342,397 A * 8/1982 Halstrick ..... A47B 57/402 403/231
4,928,834 A * 5/1990 Neiman ..... A47B 57/402 211/208
5,190,172 A * 3/1993 Tyson ..... A47B 57/402 211/192
5,377,851 A * 1/1995 Asano ..... A47B 57/402 211/192
10,610,017 B2 * 4/2020 Beadle ..... A47B 57/402
11,478,080 B2 * 10/2022 Briosi ..... F16B 12/32
2007/0042638 A1 * 2/2007 Choi ..... A47B 57/402 439/541.5
2017/0280875 A1 * 10/2017 Buckley ..... A47B 57/34

FOREIGN PATENT DOCUMENTS

DE 102006001516 A1 * 7/2007 ..... A47B 57/402
EP 0 664 094 A1 7/1995
EP 1 854 375 B1 12/2009
FR 2674915 A1 * 10/1992 ..... A47B 57/50
FR 2931044 B1 * 1/2013 ..... A47B 57/402
GB 1280157 A * 7/1972
GB 2001727 A * 2/1979 ..... A47B 57/402
GB 1604231 A * 12/1981 ..... A47B 57/402
WO WO 2019/069284 A1 4/2019

* cited by examiner

LOAD-BEARING STRUCTURE FOR SETS OF SHELVES

CROSS-REFERENCE TO RELATED APPLICATIONS

This application claims priority to IT patent application No. 102020000027699 filed on Nov. 18, 2020, and this application claims priority to and is a 371 of international PCT Application No. PCT/IB2021/060584 filed on Nov. 16, 2021, the entire contents of which are hereby incorporated by reference.

TECHNICAL FIELD

The present invention relates to a load-bearing structure for sets of shelves.

BACKGROUND ART

Load-bearing structures for sets of shelves are known, which are distinguished by the way they are assembled, the degree of modularity of the structure and the maximum load capacity of the shelves built.

Generally, the structures of known type employ vertical uprights as a supporting base on a stable surface and suitable fastening bodies which are coupleable to such uprights to make suitable supporting structures.

These structures are used both in the home and commercial sectors to preserve, display and/or store various types of products, the volume, weight and size of which can vary considerably depending on the nature of the product itself.

For this reason, the load-bearing structures of this type do employ fastening systems which are adapted to couple together different types of uprights and of fastening bodies to form a load-bearing structure of the modular type capable of housing different products depending on the users' needs.

Generally, such fastening systems comprise a fastening opening made on the vertical upright and a fastening portion made on the fastening body, insertable in the fastening opening and coupleable thereto to fasten the vertical upright and the fastening body with each other.

The load-bearing structures of this type are susceptible to improvements as far as their stability and strength is concerned.

In fact, the structural load transmitted between the fastening body and the vertical upright generally comprises at least one longitudinal compression component, which pushes the fastening body longitudinally along the upright body, and a transverse torsion component which tends to rotate the fastening body around the upright body.

However, the first fastening portion employed by this type of load-bearing structures comprises a single fastening element adapted to be inserted inside the fastening opening and arranged in support of the lower edge thereof to which it is fastened.

Therefore, the transverse torsion component pivots on the fastening element, tending to rotate the latter inside the fastening opening.

Such a rotation may cause deformations of the fastening element and/or rotations of the fastening body around the vertical upright, thus compromising the distribution of the structural load among the components of the load-bearing structure.

This drawback makes the load-bearing structures of the known type unstable and fragile and reduces their maximum tolerable load, thus reducing their sales market.

DESCRIPTION OF THE INVENTION

The main aim of the present invention is to devise a load-bearing structure for sets of shelves which allows the stability and strength of the load-bearing structure itself to be improved over those of known type.

A further object of the present invention is to devise a load-bearing structure for sets of shelves which allows coupling the fastening body to the vertical upright so as to maximize the load tolerable by the load-bearing structure.

Another object of the present invention is to devise a load-bearing structure for sets of shelves which allows the longitudinal component and the transverse component of the structural load acting on the load-bearing structure to be distributed correctly.

Another object of the present invention is to devise a load-bearing structure for sets of shelves which allows the mentioned drawbacks of the prior art to be overcome within a simple, rational, easy and effective to use as well as affordable solution.

The aforementioned objects are achieved by the present load-bearing structure for sets of shelves having the characteristics of claim 1.

BRIEF DESCRIPTION OF THE DRAWINGS

Other characteristics and advantages of the present invention will become more apparent from the description of a preferred, but not exclusive, embodiment of a load-bearing structure for sets of shelves, illustrated by way of an indicative, yet non-limiting example, in the accompanying tables of drawings wherein.

EMBODIMENTS OF THE INVENTION

Figure 1:
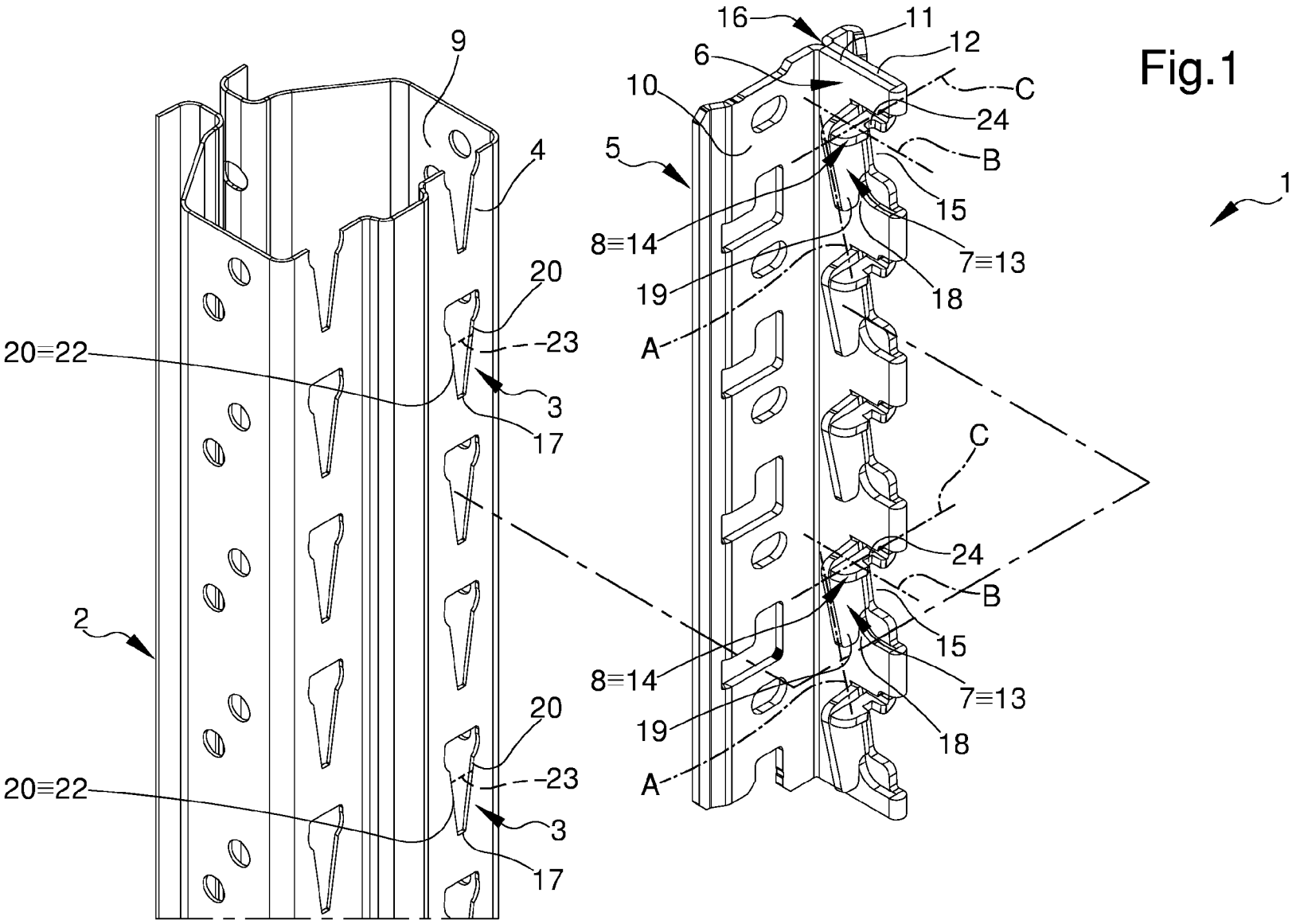
FIG. 1 is an exploded view of the load-bearing structure for sets of shelves according to the invention.

With particular reference to such figures, reference numeral 1 globally indicates a load-bearing structure for sets of shelves.

The load-bearing structure 1 for sets of shelves comprises:

- at least one vertical upright 2, provided with at least one longitudinal wall 4 and with at least one fastening opening 3 made along the longitudinal wall 4;
- at least one fastening body 5, provided with at least one fastening wall 6 and with at least one fastening portion 7, 8 made cantilevered on the fastening wall 6, insertable inside the fastening opening 3 and movable in a sliding manner inside the latter between a fastening configuration, in which it is coupled to the fastening opening 3, by fastening the vertical upright 2 to the fastening body 5, and at least one free configuration, in which it is uncoupled from the fastening opening 3, thus freeing the vertical upright 2 from the fastening body 5.

Preferably, the vertical upright 2 is of the type of an upright of known type, arranged, in use, resting on the ground and extending longitudinally vertically.

Furthermore, the vertical upright 2 comprises a plurality of perimeter walls 9 associated continuously with each other to define, together with the longitudinal wall 4, the conformation of the vertical upright 2.

Preferably, the longitudinal wall 4 and the fastening wall 6 are of substantially flat conformation.

In this way, the longitudinal wall 4 and the fastening wall 6 are arranged facing substantially parallel to each other in the fastening configuration.

In particular, the longitudinal wall 4 and the fastening wall 6 are arranged in contact with each other in the fastening configuration.

Advantageously, the longitudinal wall 4 is associated with a perimeter wall 9 to form an angle of 90° between them.

Similarly, the fastening body 5 comprises a lateral wall 10 associated with the fastening wall 6, so as to form an angle of 90° between them.

Furthermore, the perimeter wall 9 and the lateral wall 10 are of substantially flat conformation. Consequently, the perimeter wall 9 and the lateral wall 10 are arranged facing substantially parallel to each other in the fastening configuration.

Figure 2:
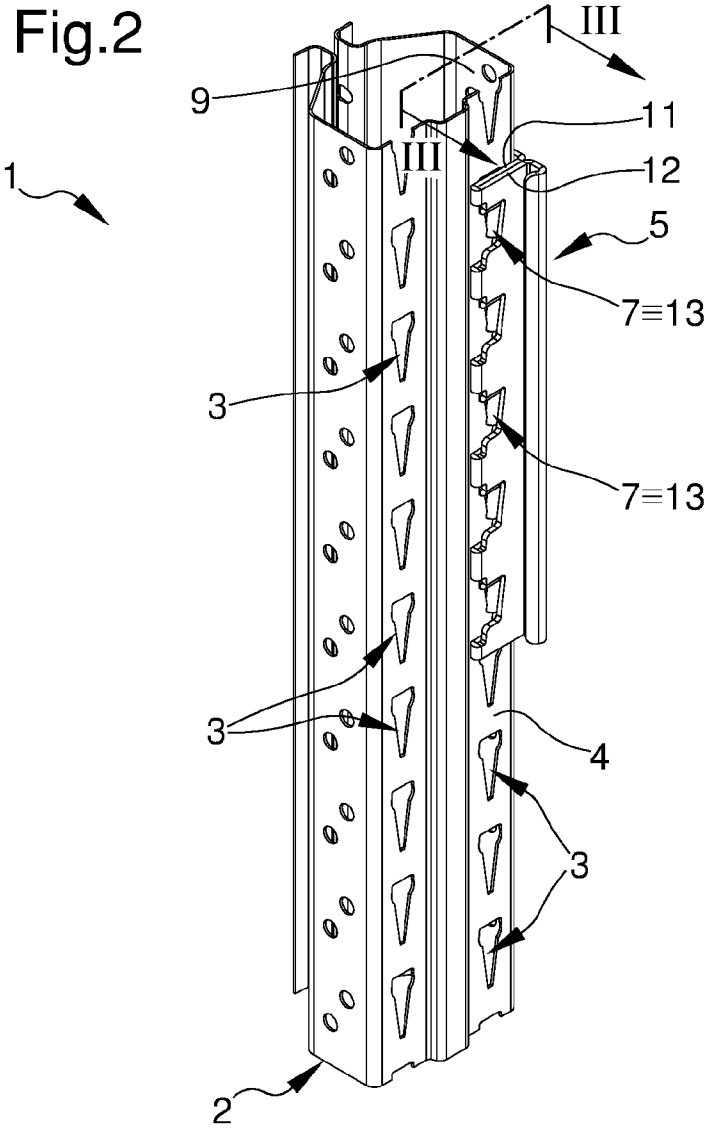
FIG. 2 is an axonometric view of the load-bearing structure for sets of shelves according to the invention.

In particular, the perimeter wall 9 and the lateral wall 10 are arranged in contact with each other in the fastening configuration, as shown in FIG. 2.

Advantageously, the fastening portion 7, 8 is coupleable by slotting into the fastening opening 3 in a removable manner.

In addition, further embodiments of the structure 1 cannot be ruled out wherein the vertical upright 2 comprise a plurality of longitudinal walls 4 arranged transversely to each other and each one provided with a plurality of fastening openings 3.

In particular, the fastening portion 7, 8 comprises a first fastening element 7, which extends along a first direction of extension A, and a second fastening element 8, which extends along a second direction of extension B substantially transverse to the first direction of extension A.

This expedient allows the fastening portion 7, 8 to be fastened inside the fastening opening 3 by means of two fastening elements 7, 8 which extend along two different directions of extension A, B, thus increasing the stability and strength of the fastening configuration and the maximum load tolerated by the structure 1.

Conveniently, the first and the second fastening elements 7, 8 protrude cantilevered from the fastening wall 6 along a direction of development C substantially orthogonal to the fastening wall 6 and to the first and the second directions of extension A, B.

In addition, the first and the second directions of extension A, B are arranged substantially parallel to the fastening wall 6.

In particular, in the fastening configuration, the first and the second fastening elements 7, 8 extend along their respective directions of extension A, B inside the fastening opening 3 to fasten to the longitudinal wall 4 at the point where at least two different fastening points are located.

Preferably, the first and the second fastening elements 7, 8 are arranged adjacent to each other.

Furthermore, the first and the second fastening elements 7, 8 are arranged adjacent to each other to form a predefined separation angle between the first and the second directions of extension A, B.

Advantageously, the fastening wall 6 comprises a first panel and a second panel 11, 12, overlapping each other and comprising a first folded portion 13, defining the first fastening element 7, and a second folded portion 14, defining the second fastening element 8, respectively.

Furthermore, the first folded portion 13 defines a passage gap 15 and the second folded portion 14 is arranged through the passage gap 15.

In particular, the first folded portion 13 defines a passage gap 15 on the first panel 11.

In other words, the first folded portion 13 is made by folding a portion of the first panel 11, on which, in this way, the passage gap 15 is made at the same time.

Similarly, the second folded portion 14 is made by folding a portion of the second panel 12 at the point where the passage gap 15 is located.

Furthermore, the folding of the second folded portion 14 defines a corresponding passage opening made on the second panel 12 at the point where the passage gap 15 is located.

In this way, the first and the second folded portions 13, 14 extend cantilevered along the direction of development C from the same side of the fastening wall 6.

Figure 3:
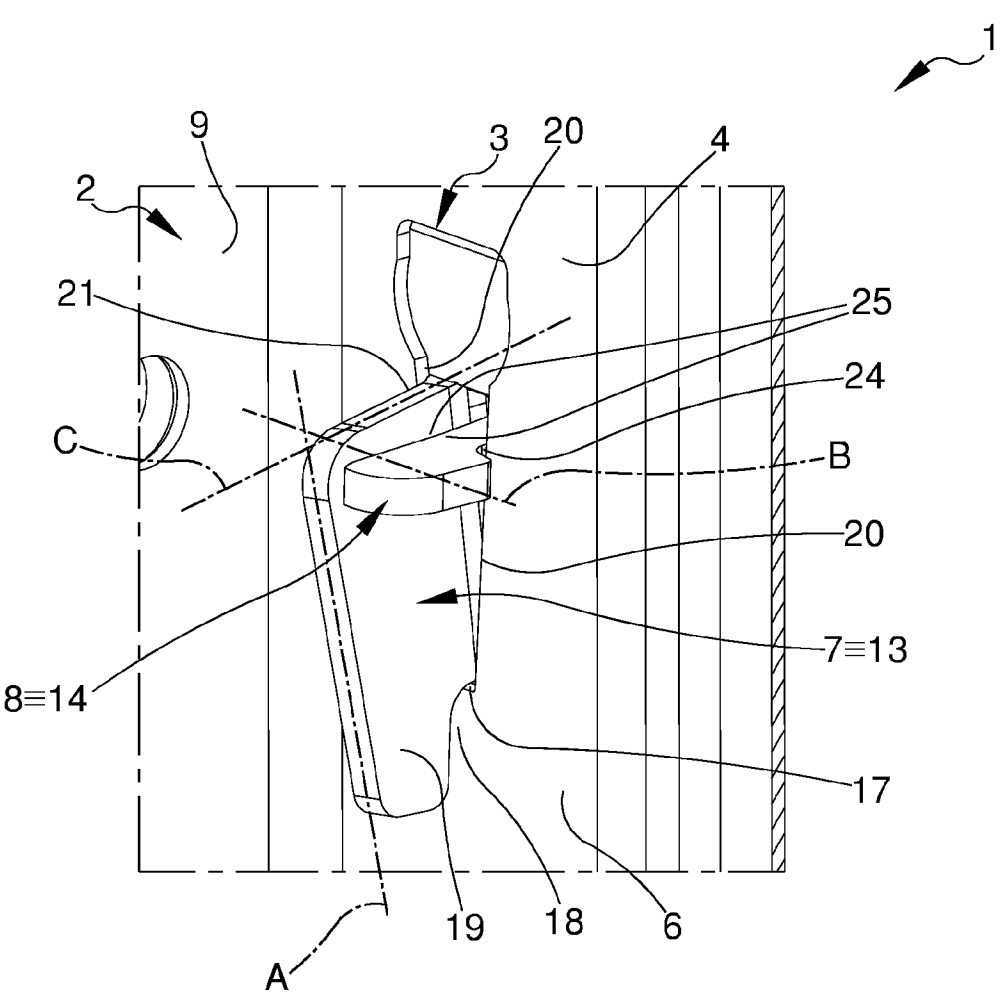
FIG. 3 is a detailed view of some components of the load-bearing structure for sets of shelves according to the invention.

The first and the second folded portions 13, 14 have a substantially flat conformation, as shown in FIG. 3.

Advantageously, the fastening wall 6 comprises a slab-shaped element 16, folded on itself and defining the first panel and the second panel 11, 12.

Preferably, the slab-shaped element 16 coincides with the fastening body 5, which is made by means of machining operations, such as e.g. bending and cutting, of an individual slab-shaped element 16.

Conveniently, the vertical upright 2 comprises at least one perimeter edge 17 which delimits at least partly the extension of the fastening opening 3.

Furthermore, the first fastening element 7 and the fastening wall 6 define a slit 18 inside which the perimeter edge 17 is housed by slotting in the fastening configuration.

This expedient prevents the fastening body 5 from moving along the direction of development C in the fastening configuration.

Preferably, the perimeter edge 17 defines at least one lower boundary of the fastening opening 3.

In particular, the first fastening element 7 comprises at least one hook-shaped portion 19 extending substantially parallel to the fastening wall 6, to define the slit 18 with the latter.

The slit 18 is arranged, in the fastening configuration, inside the fastening opening 3 astride of the perimeter edge 17.

In fact, in the fastening configuration, the first fastening element 7 is arranged in support to the perimeter edge 17 from top to bottom.

Advantageously, the vertical upright 2 comprises at least a lateral margin 20 which, at least partly, delimits the extension of the fastening opening 3.

In particular, the lateral margin 20 defines at least one lateral boundary of the fastening opening 3.

Furthermore, the first fastening element 7 comprises a lateral face 21, arranged substantially transverse to the fastening wall 6 and in contact with the lateral margin 20 in the fastening configuration.

Preferably, the lateral face 21 is arranged in support onto the lateral margin 20.

The vertical upright 2 comprises a pair of lateral edges 22, positioned opposite and converging to each other to define at least one narrowing 23 of the fastening opening 3.

In particular, in the fastening configuration, the second fastening element 8 is positioned by slotting in between the lateral edges 22 at the narrowing 23.

Furthermore, the lateral edges 22 limit the lateral extension of the fastening opening 3 and their distance defines the lateral extension of the fastening opening 3.

Conveniently, the extension of the second fastening element 8 along the second direction of extension B is substantially equal to the extension of the narrowing 23.

Furthermore, the narrowing 23 divides the fastening opening 3 into two aperture stretches arranged one on top of the other, wherein the upper aperture stretch and the lower aperture stretch have a lateral extension which are greater and less, respectively, than the extension of the second fastening element 8 along the second direction of extension B.

Conveniently, the fastening body 5 comprises at least one groove 24 made on the second fastening element 8.

In addition, one of the lateral edges 22 is housed by slotting inside the groove 24 in the fastening configuration.

Further embodiments of the structure 1 cannot however be ruled out, wherein the second fastening element 8 is of substantially the same conformation as the first fastening element 7 and comprises a fastening portion defining a similar groove to the groove 24 together with the fastening wall 6.

This expedient prevents the fastening body 5 from moving along the direction of development C in the fastening configuration.

Preferably, one of the lateral edges 22 coincides with the lateral margin 20.

Furthermore, the lateral edge 22 coinciding with the lateral margin 20 is opposite the lateral edge 22 housed inside the groove 24 in the fastening configuration.

Preferably, the lateral edges 22 have the same inclination and converge with each other at the bottom.

In addition, the perimeter edge 17 is positioned between the lateral edges 22, by joining them and defining with the latter at least partly the conformation of the fastening opening 3.

Further embodiments of the structure 1 cannot however be ruled out wherein the lateral edge 22, housed inside the groove 24 in the fastening configuration, coincides with the perimeter edge 17.

Advantageously, in the fastening configuration, the second fastening element 8 is arranged substantially horizontally.

Similarly, in this configuration, the second direction of extension B is substantially horizontal.

In this way, the second fastening element 8 counteracts the transverse torsion component of any structural load operating on the structure 1. Consequently, the second fastening element 8 counteracts the rotation of the fastening body 5 around the vertical upright 2.

Furthermore, in the fastening configuration, the first fastening element 7 extends along a first direction of extension A having an inclination substantially equal to the inclination of a lateral edge 22.

This expedient, in combination with the arrangement of the second fastening element 8 in the fastening configuration, helps to counteract the transverse torsion component of any structural load operating on the structure 1.

Preferably, the first and the second fastening elements 7, 8 comprise an abutment side 25, respectively, which extends longitudinally along the direction of development C.

In particular, the abutment sides 25 are arranged side by side stopping against each other.

Furthermore, the abutment side 25 of the first fastening element 7 is arranged substantially opposite the slit 18 and the abutment side 25 of the second fastening element 8 is arranged substantially opposite the groove 24.

Conveniently, the fastening opening 3 has a substantially triangular conformation, preferably of an isosceles triangle.

Furthermore, the fastening opening 3 has an inverted triangle conformation, wherein the lateral edges 22 are arranged inferiorly to the base of the triangle, as shown in FIG. 1.

Conveniently, the vertical upright 2 comprises a plurality of fastening openings 3 spaced apart from each other by a predefined distance. In particular, the fastening openings 3 are arranged aligned with each other vertically along the body of the vertical upright 2.

Furthermore, the fastening body 5 comprises a plurality of fastening portions 7, 8 spaced apart by a distance substantially equal to the predefined distance.

In particular, the fastening portions 7, 8 are arranged aligned with each other along the fastening wall 6.

In more detail, in the fastening configuration, the fastening portions 7, 8 are arranged vertically aligned with each other.

Conveniently, the structure 1 comprises a transverse element 26, associated with the fastening body 5 and arranged, in the fastening configuration, substantially transverse to the vertical upright 2.

Preferably, the transverse element 26 is made in a single body piece with the fastening body 5.

Furthermore, in the fastening configuration, the transverse element 26 is arranged orthogonal to the vertical upright 2.

Advantageously, the structure 1 comprises a pair of fastening bodies 5 associated opposite each other with the transverse element 26 to define at least one transverse body 27.

In addition, each of the fastening bodies 5 is coupled to a respective vertical upright 2.

Figure 4:
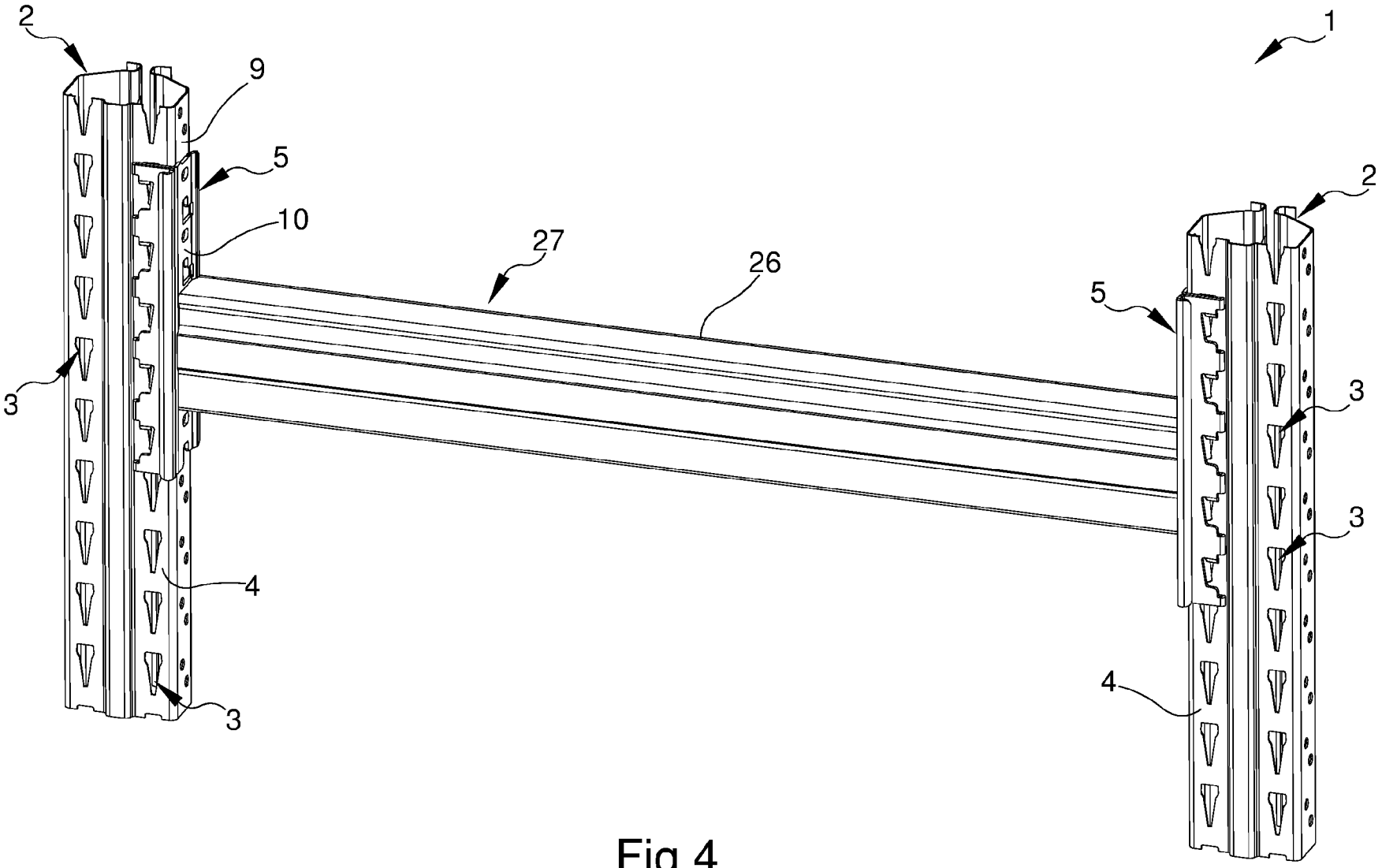
FIG. 4 is an axonometric view of another embodiment of the load-bearing structure for sets of shelves according to the invention.

In this way, the transverse element 26 is placed between two vertical uprights 2, as shown in FIG. 4.

Conveniently, the structure 1 comprises a plurality of transverse bodies 27 and a plurality of vertical uprights 2.

Consequently, a plurality of vertical uprights 2 and of transverse bodies 27 are coupled to each other to make a structure 1 of the modular type, e.g. comprising four vertical uprights 2, arranged to form the legs of a set of shelves and coupled to each other by the interposition of four transverse bodies 27, wherein each transverse body 27 is placed between two different vertical uprights 2.

It has in practice been ascertained that the described invention achieves the intended objects.

In particular, the fact is emphasized that the first and the second fastening elements allow the fastening portion to be fastened to the fastening opening at two different fastening points, thus improving the stability and strength of the same load-bearing structure with respect to those of known type.

These fastening elements also make it possible to maximize the load tolerated by the load-bearing structure.

In addition, the arrangement of the fastening elements along their respective directions of extension allows for the correct distribution of both the longitudinal and transverse components that make up the load exerted on the load-bearing structure.

The invention claimed is:

1. A load-bearing structure for sets of shelves, the load-bearing structure comprising:

at least one vertical upright, provided with at least one longitudinal wall and with at least one fastening opening made along said longitudinal wall; and at least one fastening body, provided with at least one fastening wall and with at least one fastening portion made cantilevered on said fastening wall, insertable inside said fastening opening and movable in a sliding manner inside said fastening opening between a fastening configuration, in which said fastening portion is coupled to said fastening opening, by fastening said vertical upright to said fastening body, and at least one free configuration, in which said fastening portion is uncoupled from said fastening opening, freeing said vertical upright from said fastening body, wherein said fastening portion comprises a first fastening element, which extends along a first direction of extension, and a second fastening element, which extends along a second direction of extension substantially transverse to said first direction of extension, said first and said second fastening element being adapted to fasten to said longitudinal wall in said fastening configuration, and wherein in the fastening configuration, the first fastening element and the second fastening element extend along the first direction of extension A and the second direction of extension, respectively, inside said fastening opening to fasten to said longitudinal wall at a point where at least two different fastening points are located.

2. The load-bearing structure according to claim 1, wherein said fastening wall comprises a first panel and a second panel overlapping each other and comprising a first folded portion, defining said first fastening element, and a second folded portion, defining said second fastening element, respectively.

3. The load-bearing structure according to claim 2, wherein said first folded portion defines a passage gap and said second folded portion is arranged through said passage gap.

4. The load-bearing structure according to claim 2, wherein said fastening wall comprises a slab-shaped element, folded on itself and defining said first panel and said second panel.

5. The load-bearing structure according to claim 1, wherein:

said vertical upright comprises at least one perimeter edge which delimits at least partly the extension of the fastening opening; and said first fastening element and said fastening wall define a slit inside which said perimeter edge is housed by slotting in said fastening configuration.

6. The load-bearing structure according to claim 1, wherein:

said vertical upright comprises a pair of lateral edges, placed opposite and converging to each other to define at least one narrowing of said fastening opening; and said second fastening element, in said fastening configuration, is positioned by slotting in between said lateral edges at said narrowing.

7. The load-bearing structure according to claim 6, wherein said fastening body comprises at least one groove made on said second fastening element, one of said pair of lateral edges being housed by slotting inside said groove in said fastening configuration.

8. The load-bearing structure according to claim 1, further comprising: at least one transverse element, associated with said fastening body and arranged, in said fastening configuration, substantially transverse to said vertical upright.

9. The load-bearing structure according to claim 8, further comprising: a pair of said at least one fastening body, associated opposite each other with said transverse element to define at least one transverse body and wherein each of said fastening bodies is coupled to a respective one of said at least one vertical upright.

10. The load-bearing structure according to claim 1, further comprising: a plurality of transverse bodies and a plurality of said at least one vertical uprights.

* * * * *